US005303767A

United States Patent [19]

Riley

[11] Patent Number: 5,303,767

[45] Date of Patent: Apr. 19, 1994

[54] CONTROL METHOD AND SYSTEM FOR CONTROLLING TEMPERATURES

[75] Inventor: Thomas T. Riley, Palo Alto, Calif.

[73] Assignee: Honeywell Inc., Minneapolis, Minn.

[21] Appl. No.: 7,451

[22] Filed: Jan. 22, 1993

[51] Int. Cl.[5] ..... F24F 3/00

[52] U.S. Cl. ..... 165/12; 165/22; 236/1 B; 236/1 C; 236/49.3

[58] Field of Search ..... 165/12, 22; 236/49.3, 236/1 B, 1 C

[56] References Cited

U.S. PATENT DOCUMENTS 4,200,910 6/1980 Hall ..... 165/22
4,284,126 8/1981 Dawson ..... 165/22
4,830,095 5/1989 Friend ..... 165/22
5,024,265 6/1991 Bucholz et al. ..... 165/22

*Primary Examiner*—A. Michael Chambers
*Attorney, Agent, or Firm*—Robert B. Leonard; Michael B. Atlass

[57] ABSTRACT

A system and method for controlling the operation of a Heating, Ventilation and Air Conditioning (HVAC) system for use primarily in a building having more than two controllable temperature zones. Rooms having a priority for heating or cooling are identified as such in a controller. The controller sums Temperature Differences from all controlled spaces and causes the HVAC system to operate in a first mode (e.g. heating) if the sum has a first relationship to a preselected value (e.g. sum > =0) and causes the HVAC system to operate in a second mode (e.g. cooling) otherwise.

5 Claims, 6 Drawing Sheets

| ROOM | PRIORITY | HEAT SETPOINT | COOL SETPOINT | ACTUAL TEMP | PRIORITY WEIGHT |
|---|---|---|---|---|---|
| LOBBY | X | 70 | 74 | 68 | 3 |
| HALL | | 68 | 76 | 64 | 0 |
| OFFICE | X | 70 | 74 | 68 | .8 |
| CONFERENCE | X | 72 | 74 | 78 | .8 |
| PARTS | | 65 | 75 | 64 | 0 |
| LAB | X | 70 | 72 | 74 | 1.5 |
| CONTROL | | 65 | 75 | | 0 |
| | | | | | |

COOLING FACTOR 1.2

CONTROL METHOD AND SYSTEM FOR CONTROLLING TEMPERATURES

BACKGROUND OF THE INVENTION

This invention relates to a method and apparatus for temperature control within a building. More specifically, the invention relates to a method and apparatus for concurrently controlling the temperature of many spaces within a building.

By way of background, most residential and many small commercial buildings (those of under 50,000 square feet) have a single Heating, Ventilation and Air Conditioning (HVAC) system serving all of the spaces within a building. The HVAC system typically includes apparatus for heating a medium fluid, such as water or air, apparatus for cooling the fluid, and some sort of transmission system for sending the fluid to spaces requiring heating or cooling. Typically, the HVAC system had a single transmission system which served to heat or cool the spaces. The heating and cooling systems were not used at the same time.

Connected to the HVAC system was some sort of temperature sensor and control. One prior art temperature sensor and control apparatus was the thermostat. A thermostat would be placed at some location within the building thought to be representative of the temperature of the entire building. Usually the thermostat was set by an operator to operate either in a heating mode or a cooling mode. The operator also entered a desired temperature, or setpoint, into the thermostat. The thermostat thereafter determined whether the temperature of the space varied from the setpoint, and if so, turned on the HVAC system until the difference between the setpoint and the actual temperature was eliminated. This temperature control method had the obvious problem that no matter what site was picked for the thermostat, some portions of the building were invariably too warm, while others were too cold.

In an effort to address the variance among rooms, each room was provided with a thermostat connected to the HVAC system and to a medium fluid flow control means. If one space required heating or cooling, the thermostat would cause the HVAC system to direct the conditioned medium fluid into the requesting space.

An equivalent system was provided by having a temperature sensor in each room, each temperature sensor being connected to a controller. The controller was in turn connected to the HVAC system and the plural medium fluid flow control means. Note that as a further example, plural thermostats were connected to a single controller to provide the desired control.

A problem with these last three examples existed in that while one room was calling for heat, another room might have been calling for cooling. One scheme for dealing with this problem was to have the controller average all of the differences between the setpoints and the actual temperatures for the rooms. If the average had a first relationship to a preselected constant, the HVAC system would be in a heating mode, otherwise the HVAC system would be in a cooling mode. A problem with this method was that if an unimportant room, such as an unoccupied basement, had a large temperature differential requiring heating when an important room, such as an occupied living room, had a small temperature differential requiring cooling, the basements' large heating demand would cause the HVAC system into heating mode. This leads to occupant discomfort.

In an effort to overcome this problem, the controller was modified to accept a range of values from 0% to 100% for a cooling priority. By way of example, a building owner could set a cooling priority of 30% which would cause the HVAC system to operate in cooling mode if 30% of the monitored spaces called for cooling. Thus, in a house having 8 rooms, if one room required cooling, 12.5% of the rooms required cooling, but this did not exceed the 30% minimum required and therefore cooling did not occur. If three rooms were calling for cooling, 37.5% were now calling for cooling, and therefore the HVAC system operates in cooling mode. However, even with this system, rooms which were unimportant from a temperature standpoint to the occupants could still cause undesired operation of the HVAC system. In the current example, if the three spaces calling for cooling were the basement (unoccupied), guest bedroom (unoccupied) and guest bath (unoccupied) while the other rooms in the building were calling for heating, the occupants were experiencing temperature discomfort.

It is therefore an object of the present invention to try to give heating or cooling priority to rooms that the occupants have identified as important to their comfort.

SUMMARY OF THE INVENTION

The present invention is a controller which allows occupants of a building or portion of a building having a common HVAC delivery system to prioritize the heating or cooling demands of selected rooms, and to resolve conflicts between rooms which are calling for heating and rooms which are calling for cooling. The controller is connected to the HVAC system of the building. The controller includes a processor, memory, and a communications interface. The processor controls operations of the controller by receiving information through the communications interface, consulting the memory for actions to take based upon the information received and then sending information back out through the communications interface to devices which can control the flow of a medium fluid to the controlled rooms.

The processor and the memory are adapted to store the identity of priority rooms which are those rooms of most importance to the occupants from a temperature standpoint.

The processor, acting on instructions from the memory, then calculates a temperature difference. The temperature difference is defined as the difference between an occupant defined setpoint and the actual temperature. Thereafter, the processor, again acting on instructions from the memory, sums the temperature differences. If the sum has a first relationship to a predetermined constant, then the HVAC system is put into heating mode. Otherwise, the HVAC system is in cooling mode.

In a preferred embodiment, the sum of temperature differences which identify a requirement for one of the two modes of operation of the HVAC system is multiplied by a weighting factor to give a preference for one of the two HVAC system operating modes.

In a second preferred embodiment, each temperature difference for each room may be given a weighting factor prior to performing the summation of the temperature differences.

DETAILED DESCRIPTION OF THE PREFERRED EMBODIMENT

Figures 1, 7:
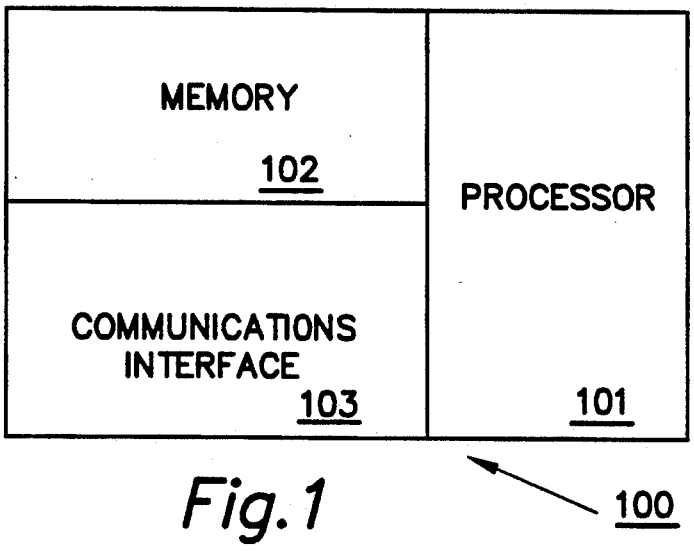
FIG. 1 is block diagram of the controller of the present invention.
FIG. 7 is a table showing data for a sample building.

Referring now to FIG. 1, thereshown is a block diagram of the inventive controller 100. The controller includes processor 101, memory 102, and communications interface 103.

Processor 100 could be a standard microprocessor, microcontroller or other processor capable of receiving a plurality of data inputs, performing functions based on the inputs received, and producing outputs based upon the performed functions.

Memory 102 stores data and instructions for use by the processor. As an example, memory 102 may store time-temperature programs for changing setpoints in rooms depending upon the current time, special event programs which cause the HVAC system to take predetermined steps upon the occurrence of a special event, such as a fire, or the priority programs set out in FIGS. 3, 4, 5 or 6. The processor 101 calls the memory periodically for instructions on how the processor should operate and what functions it should perform. The memory may include Random Access Memory (RAM), Read Only Memory (ROM) and variants thereof.

Communications interface 103 generally includes both hardware and software for converting signals coming into the processor into a format which the processor understands, and converting outgoing signals into a format which the recipient devices can understand.

Figure 2:
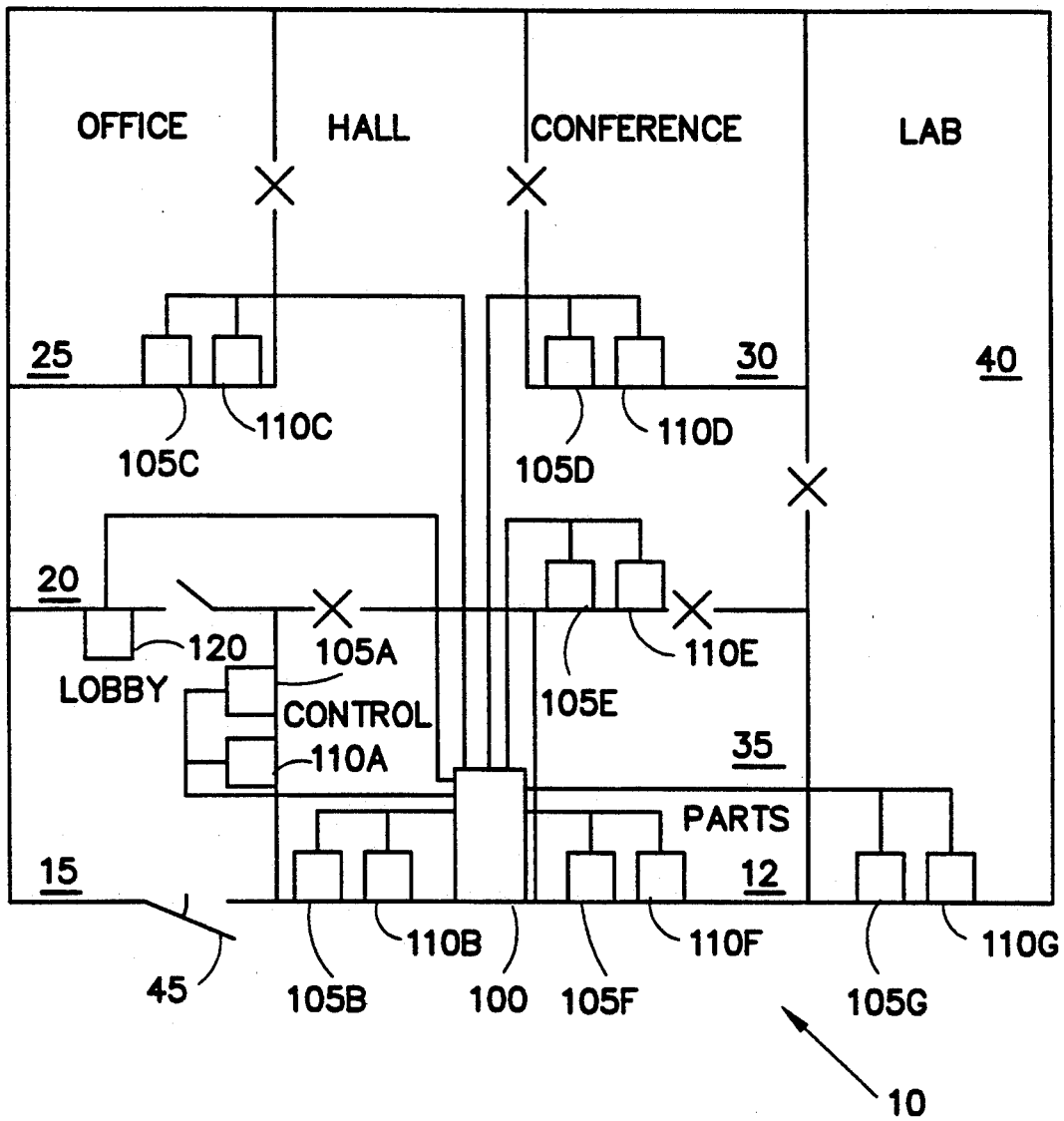
FIG. 2 is a block diagram of a temperature control system within a building which is shown in plan view.

Referring now to FIG. 2, thereshown is a sample floor plan of a building 10 having rooms 15, 25, 30, 35, 40, 45 and hallway 20, and which includes a temperature control system 12. The temperature control system controls the operation of the HVAC system (not shown) in the building. The HVAC system generally has first and second modes, which may be heating or cooling. The temperature control system includes controller 100, temperature sensors 105A–105G, medium fluid control means 110A–110G and operator interface 120.

The temperature sensors 105A–105G sense the temperature of the room that they are in and create a signal representative of the temperature which is then communicated to the controller. Note that while FIG. 2 depicts each temperature sensor being connected individually with the controller 100, that a bus architecture would work equally as well and falls within the spirit of the invention. The temperature sensors 105A–105G could be simple temperature sensors, or they could be thermostats.

Controller 100 receives the temperature signal from each of the sensors 105A–105G and performs the steps detailed in FIGS. 3, 4,5 or 6 and determines whether the HVAC system should operate in heating or cooling mode. If thermostats are used instead of mere temperature sensors, then in an alternative embodiment, the thermostats may calculate the Temperature Differences and transmit these differences to the controller, thus skipping the initial step of the methods of FIGS. 3,4, 5 or 6.. Thereafter, controller 100 puts the HVAC system into the proper mode, and causes medium fluid control means 110A–110G to open, close or move depending upon whether the current mode will meet its associated heating or cooling needs, and how far that zone's actual temperature deviates from its setpoint.

The medium fluid control means 110A–110G could be, without limitation, vent dampers for forced air systems, electric valves for hydronic systems, or relays for other systems.

The operator interface provides the building occupants with a device and method for modifying the setpoint of the rooms, and for identifying rooms to be given a priority. The operator interface is used for storing the data appearing in FIG. 7 in controller 100, and may have a display screen which is capable of displaying this information in tabular form such as that shown. The data in FIG. 7 includes a room identifier, Priority column, heat setpoint, cooling setpoint, actual temperature, weighting factor (optional). Usually either the priority or weighting columns will be used, not both. A heating or cooling factor may also be entered through the operator interface, although this would replace only the weighting column.

Figure 3:
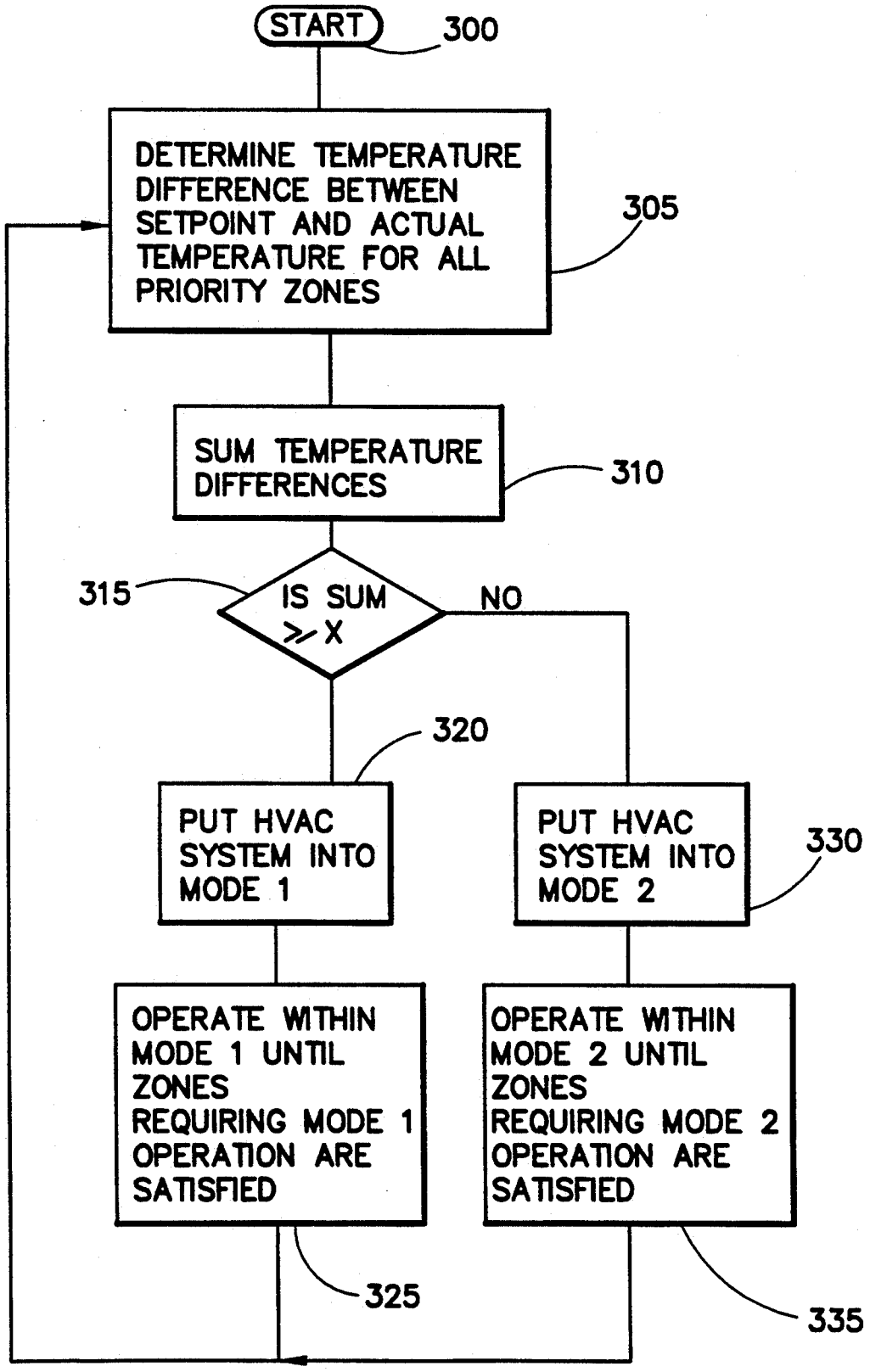
FIG. 3 is a flow chart of the method of the controller.

Referring now to FIG. 3, thereshown is a flow chart of inventive priority method. After starting at block 300, the method calculates a Temperature Difference for each priority space, which is defined as the difference between the setpoint temperature and the actual temperature of the space at block 305. The method then sums all of the Temperature Differences at block 310 and then compares the sum to a predetermined value, X, at block 320. If the sum is greater than or equal to X, the controller causes the HVAC system to go into a first mode at block 320, and all rooms that require the HVAC system to be in mode 1, are conditioned at block 325. Note that operation within mode 1 includes periodic rechecking of the temperature of the spaces which are receiving conditioning, and adjustment to the medium fluid control means as the heating or cooling needs of the space are affected.

If the sum is less than X, then the controller causes the HVAC system to operate in mode 2 at block 330, and block 335 operates in a similar fashion to that of block 325.

Using the data from FIG. 7 as an example for operation of the method of FIG. 3, four rooms are shown to have priority, the lobby, office, conference room and lab. Following the steps of FIG. 3, there are Temperature Differences of 2, 2, −4 and −2. By adding these Temperature Differences, a sum of −2 is reached. For convenience, X here will be set equal to 0, mode 1 will be heating and mode 2 will be cooling. This will be the most common set up for convenience since intuitively if the sum is greater than zero given the definition of Temperature Difference, heating is required, otherwise, cooling is required. Because this example produces a sum of −2, the HVAC system will enter a cooling mode until the lab and conference room needs are met.

Figure 4:
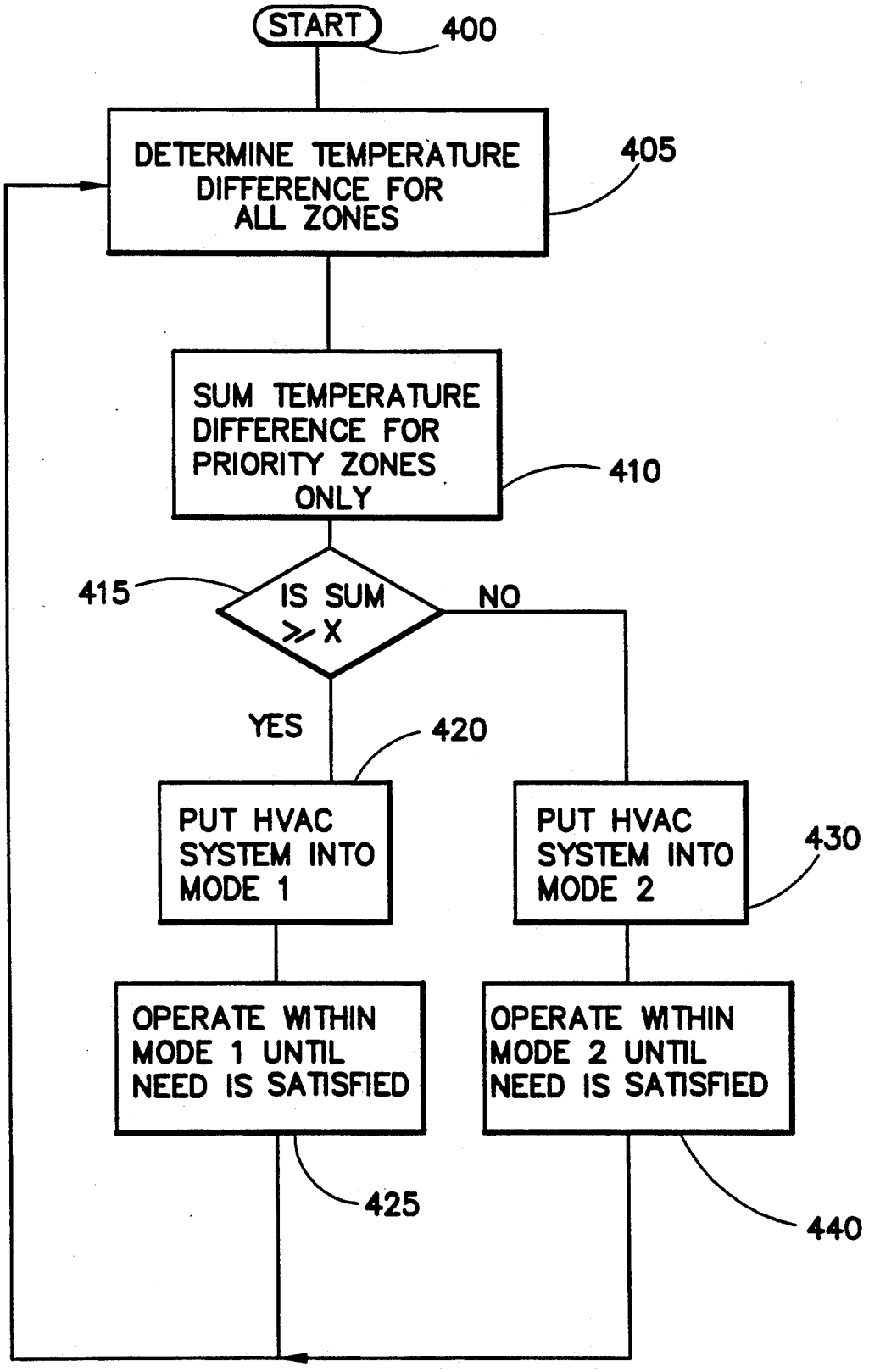
FIGS. 4–6 are further preferred embodiments of the method of the present invention.

Referring now to FIG. 4, thereshown is a slightly modified version of the method shown in FIG. 3. The modifications occur within the second and third blocks of the method. In block 405, instead of calculating just the Temperature Differences of the priority zones, the Temperature Differences of all the zones are calculated by the controller. Next, at block 410, the controller sums only those zones identified as priority zones. These are the only differences between FIG. 4 and FIG. 3.

Figure 5:
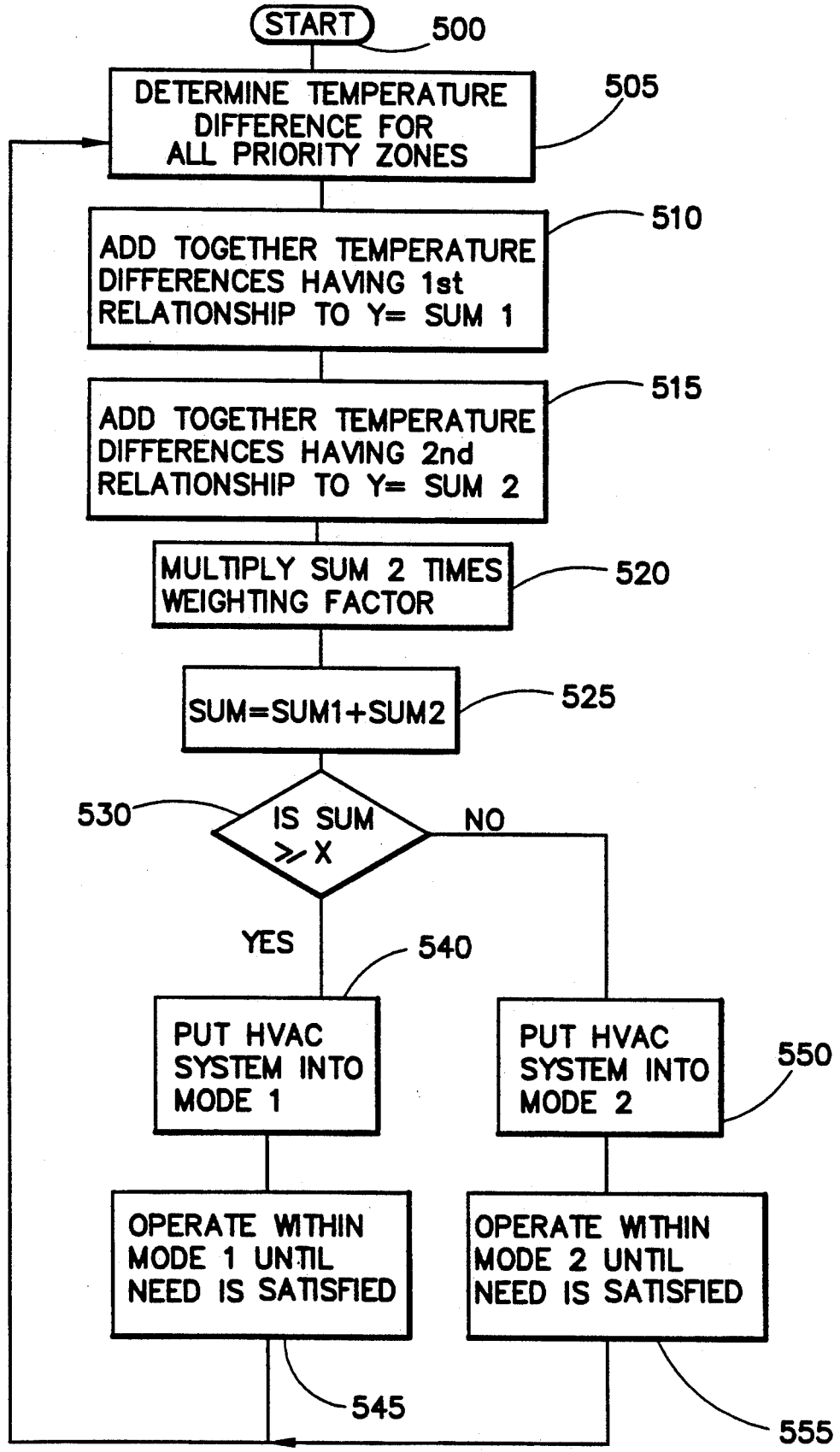

Referring now to FIG. 5, thereshown is yet another preferred embodiment of the inventive method. After starting at block 5, the method calculates Temperature Differences for all priority zones at block 505. Next, all temperature differences having a first relationship to a value y are added together at block 510. All other values are added together at block 515. One of the two blocks, here we are using the sum calculated in block 515, is then multiplied by a weighting factor in block 520 which recognizes a preference for operation in one of the two HVAC modes. Then, at block 525, the two sums are added. The result is compared to value X at block 530 and the HVAC system is forced into operation in one of two modes at blocks 540,545,550 and 555.

Using the data from FIG. 7 in the method of FIG. 5, again the Temperature Differences are 2,2,−4 and −2 and a cooling preference of 1.2. Here we will pick X=0, Y=0, first relationship is >=, second relationship is<, heating as mode 1 and cooling as mode 2 again for convenience and intuitiveness. Performing the steps of block 510 and 515 on these values produces a sum 1 of 4 and a sum 2 of −6. Performing the block 520 step of multiplying sum 2 by 1.2 produces a result of −7.2. Next, calculating the sum of block 525 produces −2.2 which will cause the controller to cool the spaces requiring cooling through performance of steps 530, 550 and 555.

Figure 6:
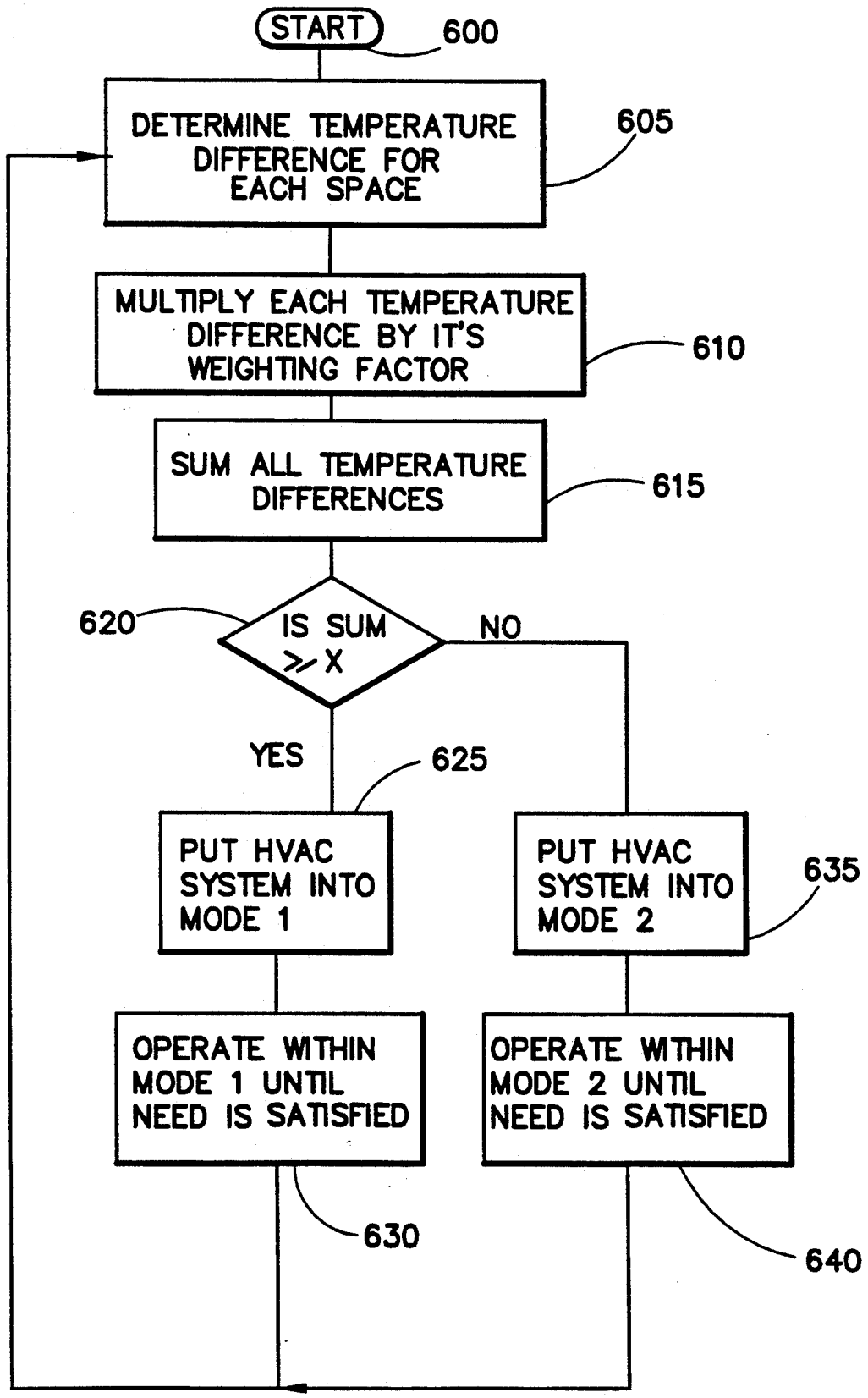

FIG. 6 provides still another embodiment of the inventive method. After starting at block 600, the method determines the temperature difference for each space at block 605. Next, each temperature difference is multiplied by a weighting factor which is associated with the space at block 610. At block 615, the weighted temperature differences are summed. Then, at block 620, the sum is compared with a value X, and the appropriate HVAC mode is selected and operated in blocks 625,630, 635 and 640.

Again using the data of FIG. 7, block 605 produces Temperature Differences of 2,2,−4 and −2. Multiplying these values by their weighting factors as specified in block 610 produces weighted Temperature Differences of 6, 1.6, −3.2 and −3. Next, the sum of 1.4 is calculated in step 615 which causes the controller to turn on the HVAC systems' heat mode in blocks 625 and 630.

I claim:

1. A method of operating a control system for controlling the temperature in a plurality of spaces within a building having an HVAC system connected to the control system, the HVAC system having first and second modes of operation, the control system including a controller and a first plurality of temperature sensors for determining an actual temperature of a space, the controller storing a second plurality of setpoints associated with the first plurality of temperature sensors, the controller further storing a list of priority spaces, comprising the steps of:

calculating Temperature Differences for each of the first plurality of sensors having a setpoint, said Temperature Difference being equal to the difference between said setpoint and said actual temperature;

creating a sum of said Temperature Differences associated with said spaces on said list of priority spaces;

causing said HVAC system to operate in the first mode if said sum has a first relationship to a predetermined value;

causing said HVAC system to operate in the second mode otherwise.

2. A controller for controlling a HVAC system having first and second modes, in a building having many rooms, each temperature controlled room having a Temperature Difference between a preselected setpoint and an actual temperature for the space, comprising:

a processor for receiving instructions and data and performing tasks based on said instructions and data;

a communications interface connected to said processor for receiving communications from outside the controller and translating the received signals into a form which can be understood by said processor, said communications interface also translating signals received from said processor into a form which can be used by devices connected to the controller;

memory for storing instructions and data, said memory storing a list of priority spaces, said memory further storing instructions causing said processor to sum the Temperature Differences of said priority spaces, said instructions further causing said controller to produce a signal to the HVAC system to operate in the first mode if said sum has a first relationship to a preselected value and a second mode otherwise.

3. The apparatus of claim 2, wherein a plurality of temperature sensors is connected to the controller, and:

said memory stores a setpoint for at least two of the plurality of temperature sensors in a space with, said memory further storing instructions which causes said processor to calculate the Temperature Differences.

4. The apparatus of claim 2, wherein a plurality of thermostats are connected to the controller, said thermostats calculating the Temperature Differences, and:

said memory stores instructions which cause the processor to poll said plurality of thermostats for their Temperature Difference.

5. The apparatus of claim 2, wherein:

said memory stores a weighting function which gives a preference to one of the modes, said processor using said weighting function during the calculation of said sum.

* * * * *